United States Patent [19]

Kuhn

[11] 4,114,613

[45] Sep. 19, 1978

[54] FOOT REST

[76] Inventor: Margrit Kuhn, Bannholzstrasse 12, Vaduz, Liechtenstein, FL-9490

[21] Appl. No.: 758,842

[22] Filed: Jan. 13, 1977

[30] Foreign Application Priority Data

Nov. 17, 1976 [CH] Switzerland ..... 14462/76

[51] Int. Cl.[2] ..... A61F 5/00

[52] U.S. Cl. ..... 128/80 R; 128/71

[58] Field of Search ..... 128/69, 70, 71, 72, 128/73, 74, 75, 83, 80 R; 272/145

[56] References Cited

U.S. PATENT DOCUMENTS

| | | | |
|---|---|---|---|
| 2,934,063 | 4/1960 | Elsasser | 128/71 |
| 3,568,669 | 3/1971 | Stites | 128/71 |
| 3,589,358 | 6/1971 | Megal | 128/71 |

FOREIGN PATENT DOCUMENTS

| | | | |
|---|---|---|---|
| 445,717 | 2/1968 | Switzerland | 128/71 |

*Primary Examiner*—John D. Yasko

*Attorney, Agent, or Firm*—Darbo & Vandenburgh

[57] ABSTRACT

The present invention provides a foot rest including a foot support mounted on a square tube which surrounds and is longitudinally slidable on a rail, a bearing rigidly mounted on said square tube, a rod pivotably mounted in said bearing and extending in the direction of and disposed above said foot support, a pair of laterally spaced curved, ellipsoidal or roll-shaped pressure pads fastened to an end region of the rod remote from the bearing and a vertically adjustable pressing device mounted on the square tube between the bearing and the foot support, said pressing device being adapted to move the pressure pads towards the foot support to abut the instep of a foot.

11 Claims, 4 Drawing Figures

FOOT REST

The present invention relates to a foot rest which is provided with a foot support slidable in the longitudinal direction and with a curved, ellipsoidal or roll-shaped pressure pad abutting against the instep of the foot. This kind of foot rest is used for home training and fitness devices as well as for cots intended for therapeutical purposes and yoga.

Swiss Pat. No. 445 717 discloses a foot rest in which the curved, ellipsoidal or roll-shaped pressure pad abutting against the instep of the foot is adjustably disposed on a freely swingable toothed rack. In practice it has been found that this type of foot rest does not provide the required safety since the pressure pad arranged at the instep of the foot cannot be vertically adjusted with sufficient accuracy and abuts with only insufficient pressure.

According to the present invention there is provided a foot rest including a foot support mounted on a square tube which surrounds and is longitudinally slidable on a rail, a bearing rigidly mounted on said square tube, a rod pivotably mounted in said bearing and extending in the direction of and disposed above said foot support, a pair of laterally spaced curved, ellipsoidal or roll-shaped pressure pads fastened to an end region of the rod remote from the bearing and a vertically adjustable pressing device mounted on the square tube between the bearing and the foot support, said pressing device being adapted to move the pressure pads towards the foot support to abut the instep of a foot.

In accordance with the present invention, a bearing rigidly fixed on a square tube which encloses the rail, has a rod pivotably mounted thereon which rod extends in the direction of the foot support and is disposed above the foot support also mounted in the square tube, two laterally spaced curved, ellipsoidal or roll-shaped pressure pads are fastened to the end region of the rod remote from the bearing and a vertically adjustable pressing device is mounted on the square tube between the bearing and the foot support, said pressing device being adapted to move the pressure pads towards the foot support.

Figure 1:
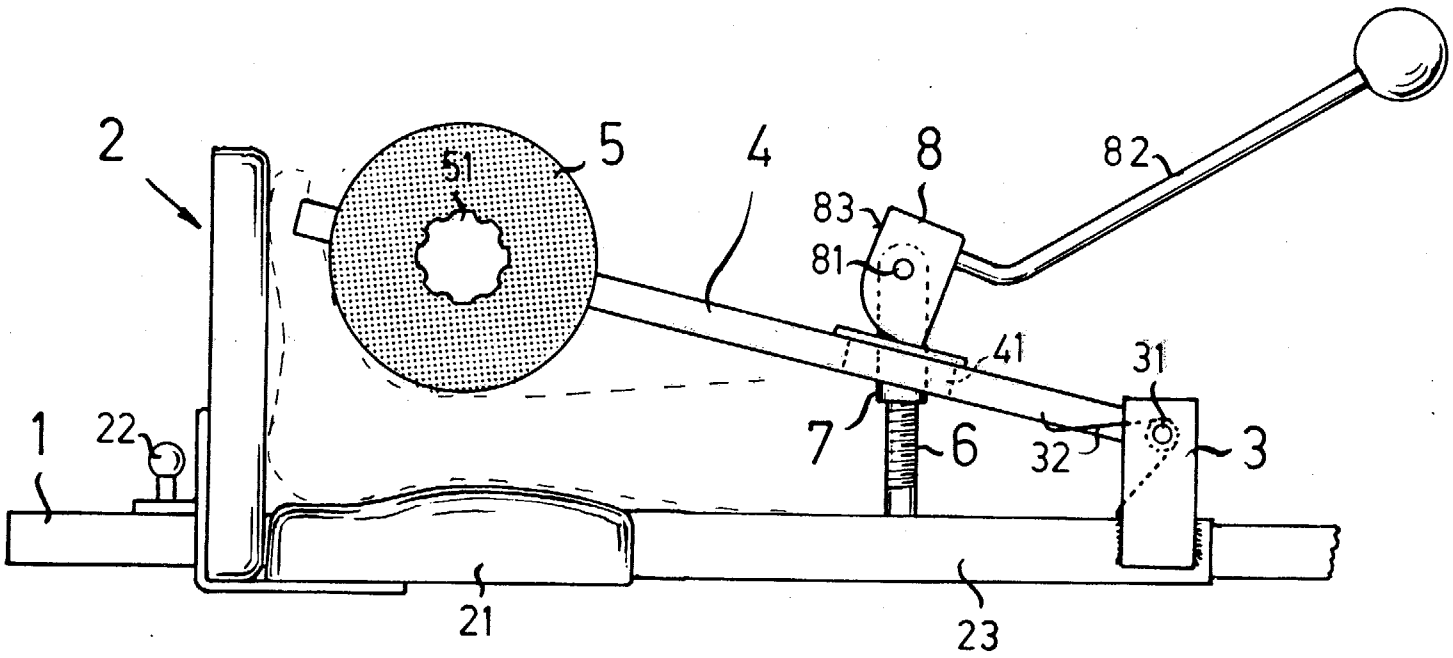
Figure 3:
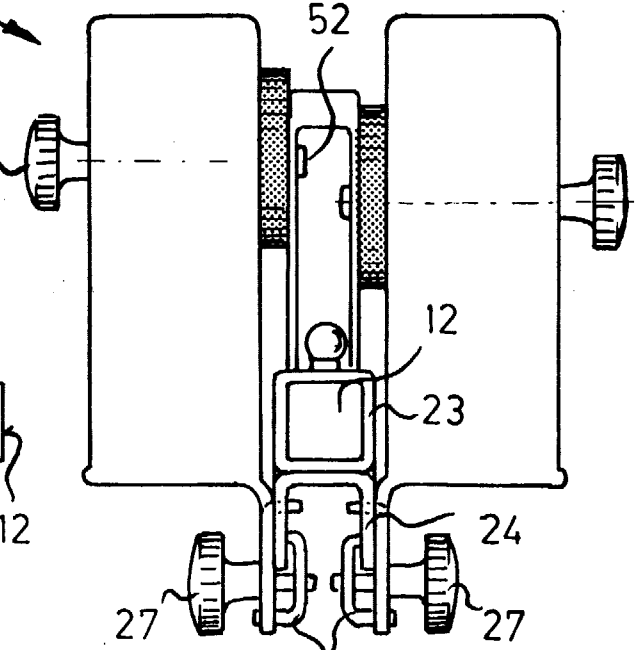
Figure 2:
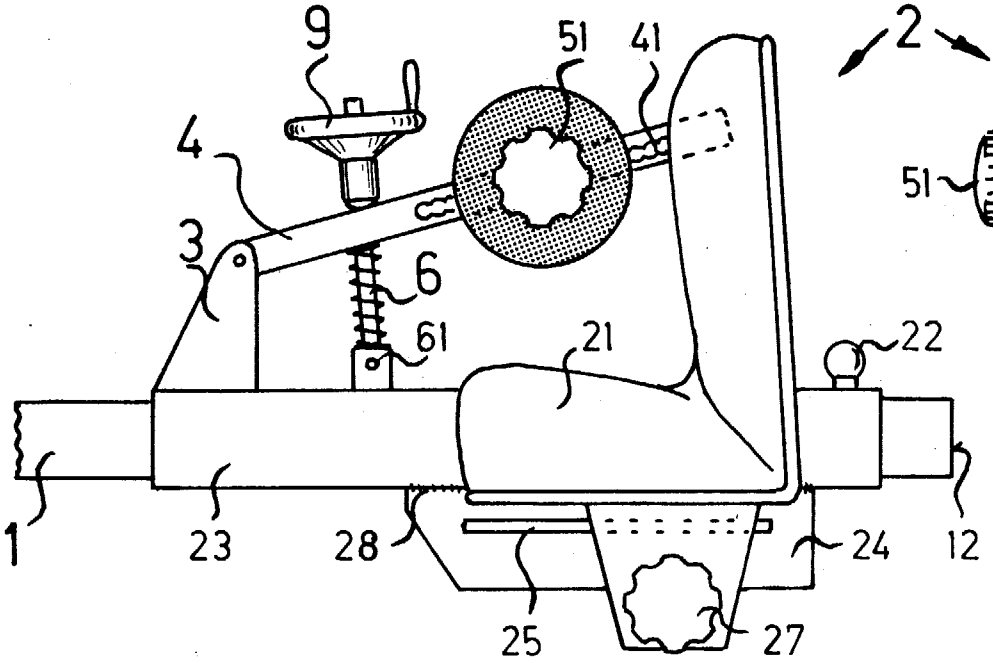
Figure 4:
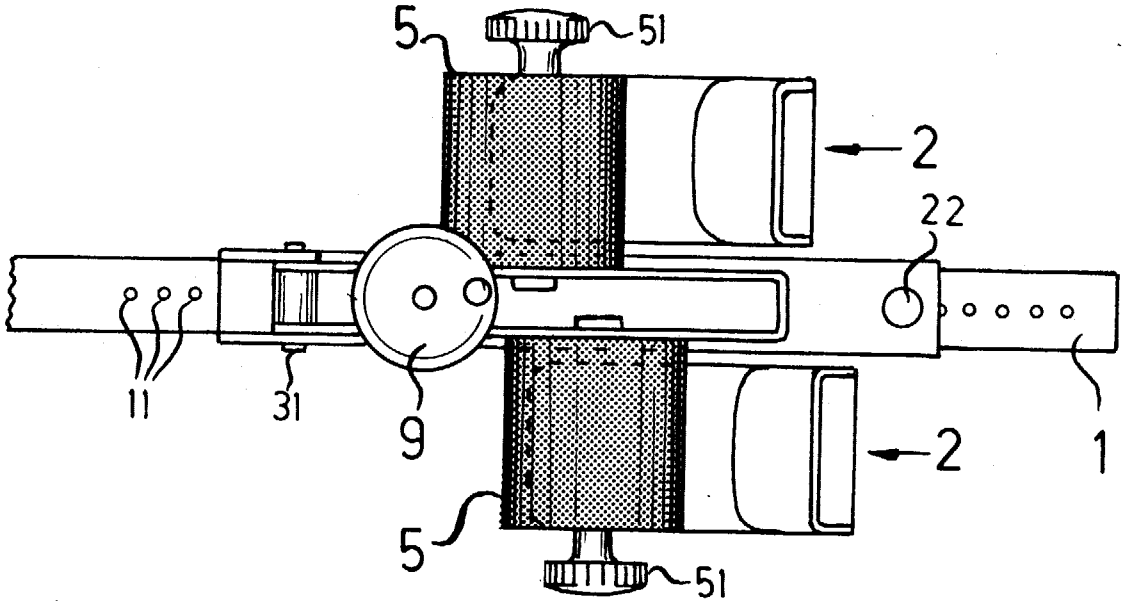

The present invention will be further illustrated by way of the accompanying drawings in which FIG. 1 is a side elevation of a foot rest with pressure rolls which are adjustable relative to each other according to the embodiment of the present invention, FIG. 2 is a side elevation of a foot rest with foot supports which are additionally adjustable relative to each other according to another embodiment of the present invention, FIG. 3 is a rear view of the foot rest of FIG. 2 and FIG. 4 is a plan view of the foot rest of FIG. 2.

Referring to the drawings, foot support 2 is mounted on a frame which includes a rail and a carriage 23 in the form of a square tube slidable longitudinally of the rail 1. Since both the rail and the tube are square one cannot rotate with respect to the other. A member 21 of the foot support 2 serves as a support for the heel and lower leg. In the embodiment according to FIG. 1 the member 21 is rigidly connected to the square tube 23. A plurality of boreholes 11 in the rail 1 (FIG. 4) allows the entire foot rest to move upon disengaging a lock by a control knob 22.

A bearing 3 rigidly connected to the square tube 23 is disposed above the foot support 2. This bearing 3 comprises, for example, a pair of small plates laterally welded to the tube 23. Said small plates have a borehole through which a bolt 31 extends. A rod 4 is swingable about said bolt 31. A tube of square cross section is preferably used for both the rail 1 and a rod or arm 4.

In the region of the end of the rod 4 remote from the bearing 3, pad rolls 5 of soft elastic material are secured on both sides of the rod 4. On loosening the screw head 51 the rolls 5 can be moved in the longitudinal direction of the rod 4 and this allows each of the two rolls 5 to be individually adjusted.

At a location between the bearing 3 and the member 21 of the foot support 2 a threaded bolt 6 is vertically positioned and welded to the slidable square tube 23. The threaded bolt 6 extends through a slot 41 (shown in dashed lines) in the rod 4. A sleeve 7 having an internal thread is screwed to the threaded bolt 6. At its upper end, at right angles to the longitudinal direction, the sleeve is provided with a borehole. A cam 8 having a U-shaped cross section is pivotably connected to the sleeve 7 by means of a bolt 81. A lever 82 rigidly welded to the cam 8 allows for easy operation thereof.

In order that the rod 4 with the rolls 5 can move upwardly upon being released and can release the feet of the user, a torsion spring 32, which biases the rod 4 upwardly, is mounted on bolt 31 with its ends bearing against the rod and bearing 3. A compression spring attached concentrically with respect to the bolt 6 can be used instead of a torsion spring (see FIG. 2).

When using the foot rest (according to FIG. 1) the lever 82 is pushed in the direction of the rolls 5. The rod 4 moves upwards and the cam 8 abuts against the surface 83. The user puts his feet on the foot support 2 and tentatively presses the rolls 5 downwards by pulling the lever 82 towards himself. If the roll pads 5 press too close to the toe region, then the user must loosen the control buttons 51 and shift the roll pads 5 slightly in a direction towards the bearing 3. If the pressure on the instep of the foot is slightly too low or too high, then he can screw the sleeve 7 downwardly or upardly by rotating the lever 82. As soon as the foot rest is correctly adjusted he can pull the lever 82 in a direction towards himself so that his feet are securely held in the device.

The FIGS. 2 to 4 show a foot support in which universal adjustability has been allowed for. The foot support 2 is connected to the square tube 23, which is slidable on the rail 1, and can be locked with the operating know 22. For adjusting the left and right foot supports relative to each other a U-shaped section 24 having a guide slot 25 is welded to the square tube 23 as indicated by the welding seam 28. The foot support 2 with the pad 21 is slidable in the guide slot 25 in a defined manner. With the aid of the control knobs 27 the left foot support and the right foot support can be separately clamped at any point. In this embodiment of the foot rest the construction of the pressing device differs from that of the foot rest according to FIG. 1. The rod 4 is screwed to the desired position by means of a handwheel 9. The thread bolt 6 is pivotably supported thereto at 61. The pad rolls 5, which, in this case, also are adaptable to the position of the foot support 2, are slidable within the slot 41 in the rod 4. A conical screw head 52 can be loosened with the control knobs 51 and put in the desired position in the slot 41. The roll 5 can be secured in the correct position relative to the foot support 2 by tightening the screw.

The adjustment for a person having normal limbs is shown in FIG. 2. The adjustment of the pads 5 for a person having an abnormal foot shape is shown in FIG. 3. The position for a patient having legs of unequal length and a foot deformity is shown in FIG. 4.

In social-medicine rehabilitation centres this kind of foot rest will be appreciated since it has many uses without great expenditure and since it assures a safe support of the patient which is essential for yoga cots.

The embodiments of the invention in which an exclusive property or privilege is claimed are defined as follows:

1. A foot rest comprising:

a frame; foot support means attached to said frame; an arm having two ends and positioned approximately parallel to said frame, one of said ends being in juxtaposition to said foot support means and the other of said ends being pivotally connected to said frame at a location remote from said foot support whereby said one is movable toward and away from said foot support means; pressure pad means attached to said arm adjacent said one end and movable with said arm toward and away from said foot support means; pressing means interconnecting said frame and said arm for selectively urging the arm and pressure pad means to pivot towards the foot support means; and spring means bearing against the frame and against the arm for biasing the arm for pivotal movement away from the frame.

2. A foot rest as set forth in claim 1 wherein said frame includes an elongated rod, an elongated carriage mounted on the rod and movable longitudinally thereon and means interconnecting the rod and carriage for preventing rotation of the carriage about the rod, said foot support means and said arm being connected to said carriage, said foot support means comprises two L-shaped foot supports each positioned at respective sides of said carriage, and said pressure pad means comprises two pressure pads positioned adjacent the foot supports respectively.

3. A foot rest as set forth in claim 2, including means connecting the pressure pad means and the arm for adjusting 4. A foot rest as set forth in claim 2, including means connecting the foot supports and the carriage for adjusting the position of the foot supports longitudinally along said carriage.

5. A foot rest as set forth in claim 2, including means releasably connecting the carriage and the rod for immovably fixing the position of the carriage longitudinally of the rod.

6. A foot rest as set forth in claim 1, wherein said pressing means includes a threaded bolt member, and a nut member on said bolt member.

7. A foot rest as set forth in claim 6, wherein one of said members is attached to said frame, the other of said members having a portion positioned beyond the side of the arm that is remote from said frame, and including a cam pivotally attached to said portion and arm means secured to said cam for pivoting said cam and for rotating said other member with respect to said one member.

8. A foot rest comprising:

a frame; foot support means attached to said frame; an arm having two ends and positioned approximately parallel to said frame, one of said ends being in juxtaposition to said foot support means and the other of said ends being pivotally connected to said frame at a location remote from said foot support whereby said one end is movable toward and away from said foot support means; pressure pad means attached to said arm adjacent said one end and movable with said arm toward and away from said foot support means; and pressing means interconnecting said frame and said arm for selectively urging the arm and pressure pad means to pivot towards the foot support means, said pressing means including a threaded bolt member, a nut member on said bolt member, one of said members being attached to said frame, the other of said members having a portion positioned beyond the side of the arm that is remote from said frame, and a cam pivotally attached to said portion and arm means secured to said cam for pivoting said cam and for rotating said other member with respect to said one member.

9. A foot rest as set forth in claim 8 wherein said frame includes an elongated rod, an elongated carriage mounted on the rod and movable longitudinally thereon and means interconnecting the rod and carriage for preventing rotation of the carriage about the rod, said foot support means and said arm being connected to said carriage, said foot support means comprises two L-shaped foot supports each positioned at respective sides of said carriage, and said pressure pad means comprises two pressure pads positioned adjacent the foot supports respectively.

10. A foot rest as set forth in claim 9, including means connecting the pressure pad means and the arm for adjusting the position of the pressure pad means on the arm longitudinally thereof toward and away from said other end thereof.

11. A foot rest as set forth in claim 9, including means releasably connecting the carriage and the rod for immovably fixing the position of the carriage longitudinally of the rod.

* * * * *

UNITED STATES PATENT AND TRADEMARK OFFICE

CERTIFICATE OF CORRECTION

PATENT NO. : 4,114,613

DATED : September 19, 1978

INVENTOR(S) : Margrit Kuhn

It is certified that error appears in the above-identified patent and that said Letters Patent are hereby corrected as shown below:

Column 1, line 57, --1-- should be inserted after "rail".
Column 2, line 48, "know" should read --knob--.
Column 3, line 18, --end-- should be inserted after "one".
Column 3, line 43, --the position of the pressure pad means on the arm longitudinally thereof toward and away from said other end thereof.-- should be inserted after "adjusting".

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*